United States Patent [19]

Kirrish

[11] 4,146,289

[45] Mar. 27, 1979

[54] WIRE CLAMP ASSEMBLY

[75] Inventor: Hail Kirrish, Rockford, Ill.

[73] Assignee: Textron Inc., Providence, R.I.

[21] Appl. No.: 866,552

[22] Filed: Jan. 3, 1978

[51] Int. Cl.[2] ..... H01R 9/10

[52] U.S. Cl. ..... 339/95 R; 339/246

[58] Field of Search ..... 339/95 R, 95 A, 246, 339/269, 271

[56] References Cited

U.S. PATENT DOCUMENTS

| | | | |
|---|---|---|---|
| 3,177,456 | 4/1965 | Haydu et al. | 339/246 |
| 3,398,393 | 8/1968 | Cochrum | 339/269 |

FOREIGN PATENT DOCUMENTS

| | | | |
|---|---|---|---|
| 2549869 | 3/1977 | Fed. Rep. of Germany | 339/246 |

*Primary Examiner*—Joseph H. McGlynn

*Attorney, Agent, or Firm*—Olson, Trexler, Wolters, Bushnell & Fosse, Ltd.

[57] ABSTRACT

There is disclosed a wire clamp assembly which includes a screw member and washer or clamping member in mounted relation on the screw member, and adapted to provide a terminal assembly for a terminal block or the like. The washer or clamping member comprises a generally rectangular plate-like washer having a central aperture, engageable by the screw member to be advanced downwardly for clamping a wire or wires against the surface of a terminal member. The surface of the washer member facing the terminal member surface includes two pairs of opposed ramps spaced apart from the central aperture and extending downwardly and diverging outwardly toward the outer periphery of the washer member. The same or undersurface of the washer further includes downwardly sloping corners defining sloping edge portions, for biting engagement with the wire to establish and maintain, together with the ramps, electrical and mechanical connection between the wire and the terminal member.

15 Claims, 7 Drawing Figures

WIRE CLAMP ASSEMBLY

BACKGROUND OF THE INVENTION

This invention relates generally to wire clamp assemblies for electrical terminals and more particularly to a screw and washer wire clamp assembly for holding a wire in engagement with a generally planar terminal member surface, of a terminal block or the like.

Screw and washer type clamping assemblies including a screw for threadably engaging an internally threaded terminal member and a clamping washer advanced by the screw to clamp a wire to the terminal member surface are known in the art. For example, attention is directed to U.S. Pat. Nos. 3,177,456 and 3,816,820 which disclose this type of arrangement. Many of the clamping washer members heretofore devised, however, allow some lateral or axial movement or twisting of the wire even after the clamping thereof, which may lead to mechanical or electrical failure of the connection. Other clamping members provide a secure connection only if great care and effort are taken in positioning the wire and while advancing the screw and washer assembly to make the connection. Also, many clamping members are designed for connecting wires in only a limited range of sizes and moreover, many connectors are inoperable in cases when two wires of different sizes are to be connected to the same terminal. Thus, many of the prior art clamping devices are not wholly satisfactory in use, as they require substantial time and effort in establishing mechanically and electrically acceptable connections, and furthermore offer a substantial opportunity for error in selecting the proper device for the wire size to be connected. Various clamping washers designed for use in such assemblies, in an attempt to alleviate some of these problems, are relatively complex in form, and correspondingly difficult and expensive to manufacture. As such, there existed a need for a more dependable, more versatile, and less expensive terminal washer, which need it is believed is filled by the present invention.

OBJECTS AND SUMMARY OF THE INVENTION

Accordingly, it is an object of this invention to provide a new and improved screw and washer type of wire clamp assembly which is adapted for making simple yet secure mechanical and electrical connections between a wire and a terminal.

Another object of this invention is to provide a wire clamp assembly of the type described which is further adapted to give satisfactory mechanical and electrical connection over a considerable range of wire sizes.

A further object of this invention is to provide a wire clamp assembly of the type described which is further adapted to establish acceptable mechanical and electrical connection for two wires of different sizes to the same terminal.

A stil further object of this invention is to provide a wire clamp assembly of the type described which is relatively simple to assemble with a terminal member and is also relatively simple and inexpensive in its manufacture.

Briefly, and in accordance with the foregoing objects, a wire clamp assembly for use with an internally threaded terminal member having a flat conductive surface, comprises a screw member having an externally threaded portion for engagement with said internal thread of the terminal member, a driver head and an unthreaded shank portion intermediate the driver head and threaded portion. A plate-like washer member is mounted on the unthreaded shank portion preferably in captive relation, and engageable by the fastener head to be moved toward the terminal member surface for clamping at least one wire thereagainst. The washer member has an under surface facing the flat terminal member surface, said under surface including at least one ramp defined by edge surfaces which diverge radially outwardly of the screw member and sloping downwardly toward the terminal member to increase the effective thickness thereof in this direction, the ramp being spaced apart at its inner end from the screw member and at its outer end being generally parallel with an outer periphery of the washer member.

In a preferred embodiment, the washer member is generally square and the under surface thereof includes two pairs of opposed ramps of the type described, disposed substantially symmetrically with respect to the sides of the square washer member. One opposed pair of ramps engages a a pair of wires to be clamped on opposite sides of the screw for urging the wires inwardly as the screw and washer member advance toward the terminal and the sides of the other opposed pair of ramps define generally a limit of inward movement of the wires. Further, in a preferred embodiment, the under surface of the washer includes downwardly bent corners which define pairs of downwardly sloping edges disposed generally transverse to the wire for biting engagement therewith upon full advancement of the screw and washer member with respect to the terminal member.

Other objects, features and advantages of the invention will be appreciated upon consideration of the following detailed description of the illustrated embodiment, together with the accompanying drawings, wherein like reference numerals designate like elements and components.

DETAILED DESCRIPTION OF THE PREFERRED EMBODIMENT

Figure 1:
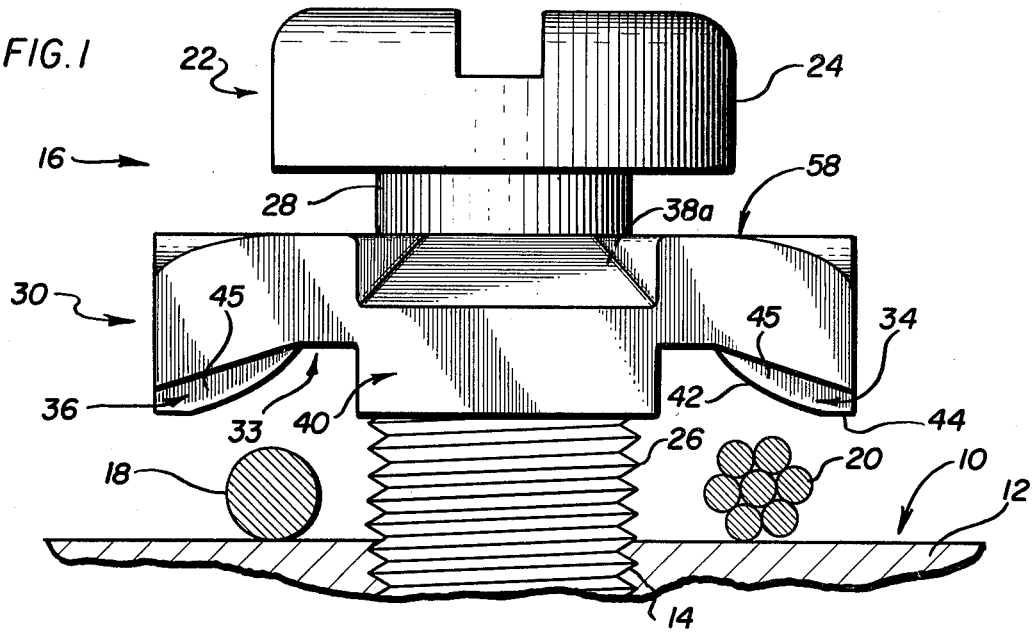
FIG. 1 is a side elevation of a wire clamp assembly in accordance with this invention in conjunction with a pair of wires and a portion of a terminal member.
Figure 2:
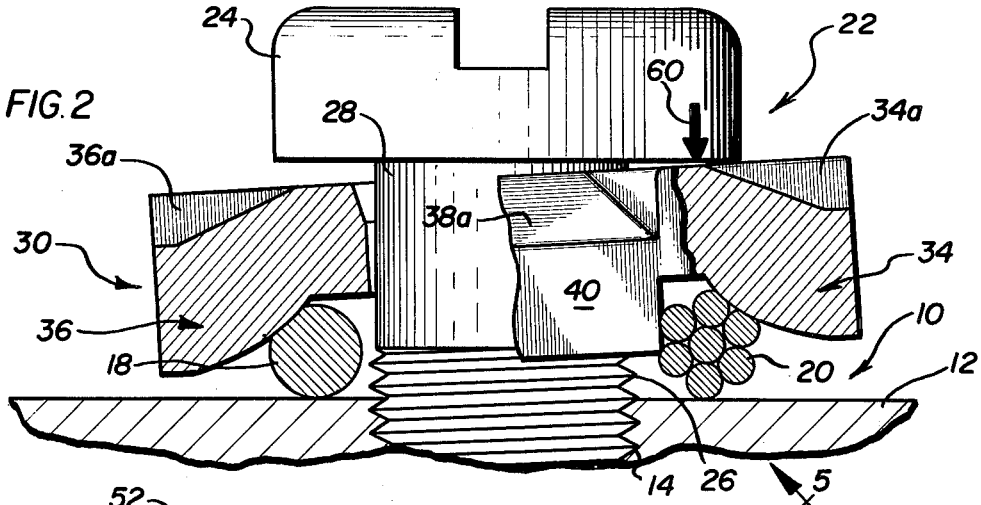
FIG. 2 is a side elevation, similar to FIG. 1 and partially cut-away, illustrating the clamping action of the wire clamp assembly of this invention.
Figure 3:
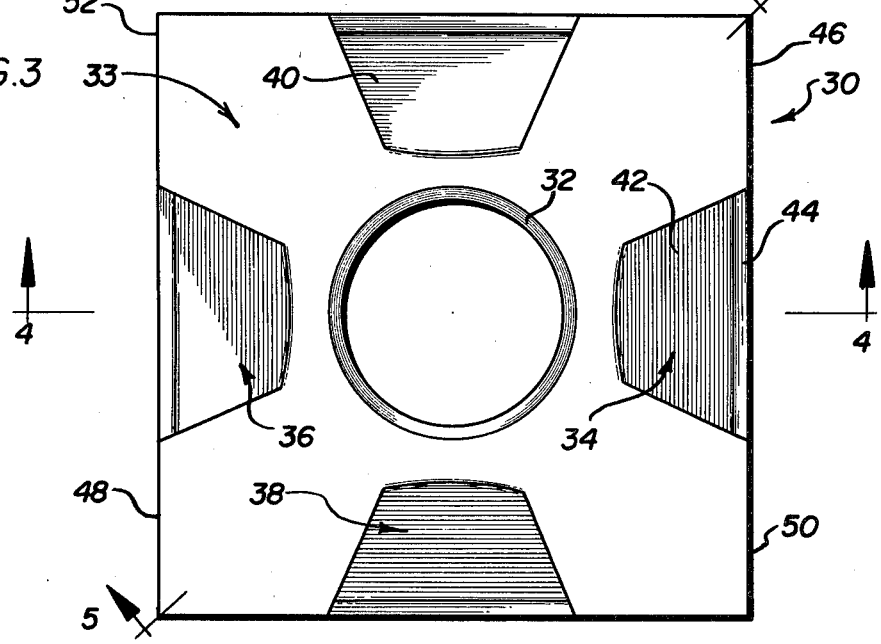
FIG. 3 is a bottom view of the clamping washer portion of the wire clamp assembly of this invention.

Referring initially to FIGS. 1 and 2, there is illustrated a support or terminal block or member 10 of conventional form which, as illustrated, includes a substantially flat plate-like conductive surface 12 and an internally threaded aperture 14, for receiving a wire clamp or terminal assembly, designated generally 16, constructed in accordance with this invention. A pair of wires 18 and 20 which are to be mechanically and electrically joined with the terminal member 10, are also illustrated. For purposes of illustrating the versatility of the present invention in accommodating wires of differing sizes or type, the wire 18 is shown as a solid wire and the wire 20 as a stranded wire of somewhat larger size or gauge than the wire 18. It will be understood, however, that the wire clamp assembly 16 of this invention is suitable for use with a considerable variety of different gauges or sizes of wires, and with wires of both the solid and stranded variety, the wires 18 and 20 being shown by way of example only.

The wire clamp or terminal assembly 16 includes a screw member 22 comprising a head or driver portion 24, an externally threaded shank portion 26 for engagement with the thread 14 of the terminal block member 10 and an unthreaded shank portion 28 intermediate the head 24 and threaded portion 26. A clamping member 30 in the form of a washer-like member having a central aperture 32 is carried by the fastener 22, and preferably is held captive on the unthreaded shank portion 28 by the thread on shank portion 26. For example, the screw member 22 may be formed from a screw blank in conventional fashion, the threaded shank portion 26 being formed by rolling, with the washer member 30 disposed over the unthreaded shank portion 28 whereby the major diameter of the threads formed thereon are larger than the diameter of the unthreaded shank portion 28 and also larger than the central apertures 32 of the washer or clamping member 30. Accordingly, the clamping member or washer 30 is held in captive relation on said fastener 22 following formation of the threaded portion 26.

As best seen in FIG. 2, the length of the unthreaded shank 28 and the diameter of the central aperture 32 are such as to permit some degree of freedom of movement of the washer or clamping member 30 with respect to the unthreaded shank portion 28 of the screw member 22. When the fastener 22 is withdrawn from the terminal 12, the washer will be raised, this fact coupled with the slight freedom of movement permitted the washer enables the wires 18 and 20 to be positioned for clamping.

The washer or clamping member 30, in the illustrated embodiment, is generally square and includes an under surface 22 which faces the terminal member 10 when the clamp assembly is joined therewith. Two pairs of opposed ramps or sloped surfaces 34, 36 and 38, 40 are formed on the surface 33 of the clamping member 30 by deforming the main body of member 30, or otherwise. These ramps are disposed substantially symmetrically proximate the mid-portion of the sides of member 30. The ramps 34, 36, 38 and 40 are generally trapezoidal, increasing in height while sloping downwardly and tapering outwardly toward the periphery of the washer 30. The ramp 34 will be described in detail hereinbelow, it being understood that the remaining ramps 36, 38 and 40 are of similar configuration.

Figure 4:
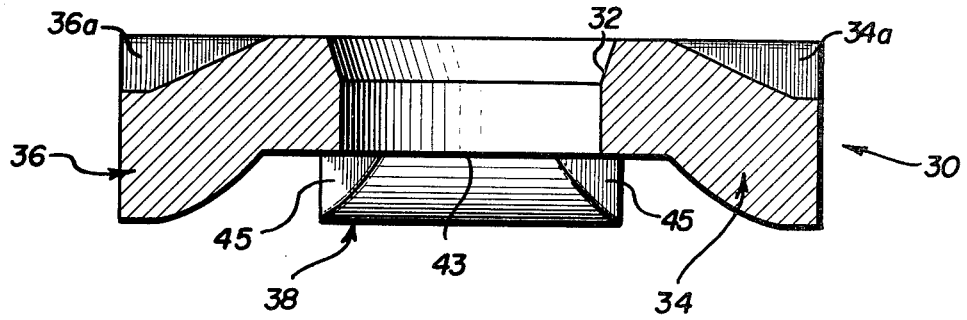
FIG. 4 is a sectional view taken generally in the plane of the line 4—4 of FIG. 3.
Figure 5:
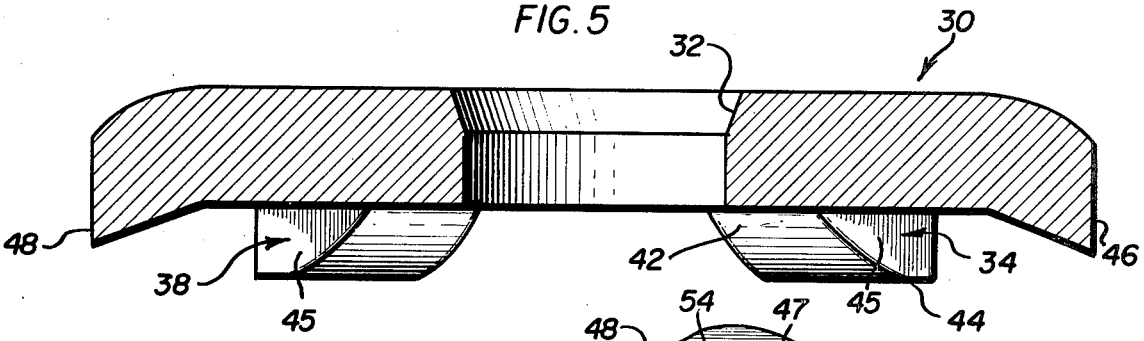
FIG. 5 is a sectional view, taken generally in the plane of the line 5—5 of FIG. 3.
Figure 6:
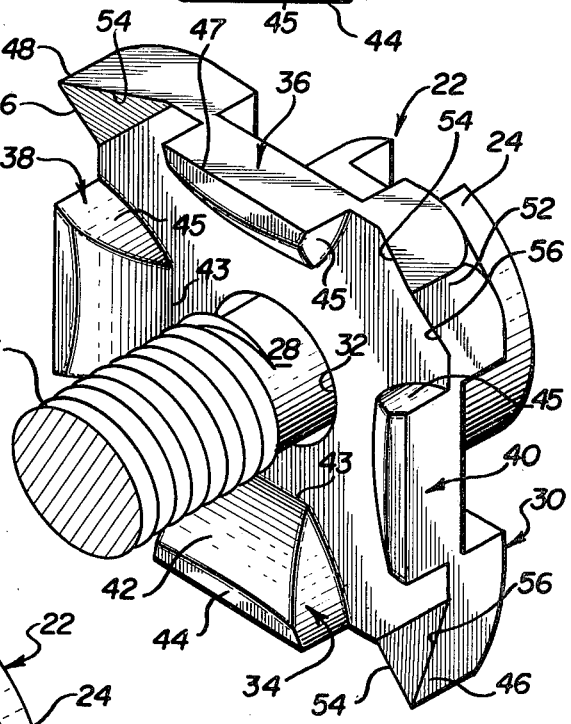
FIG. 6 is a perspective view of a wire clamp assembly according to this invention.

Referring to FIGS. 4 through 6, it will be seen that the ramp 34 includes a generally rounded outwardly tapering and downwardly sloping surface portion 42, terminating in a generally flat, non-sloping surface 44 at the outer periphery of the washer 30, thus providing said ramp with an increasing height in the outward direction. The ramp 34 is generally trapezoidal being defined by an inner edge 43, a pair of substantially planar side edges 45, which diverge in the outward direction, and the peripheral edge 47 of the member 30. It will be noted that the sloping surface 42 begins at edge portion 43 which is spaced laterally outwardly from the central aperture 32, such that the narrower base of the trapezoidal shape defined by the ramp 34 is spaced apart from the central aperture 32 and the wider base thereof is generally parallel with and below the outer periphery of the washer 30.

Figure 7:
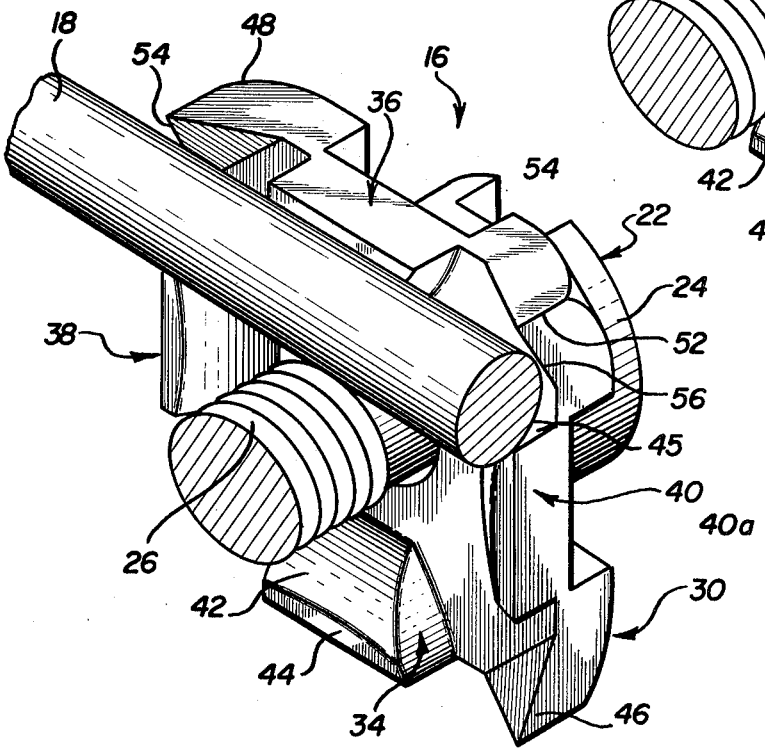
FIG. 7 is a perspective view, similar to FIG. 6 of the wire clamp assembly thereof in conjunction with a wire.

With reference to FIGS. 5 through 7, attention is directed to the corners 46, 48, 50 and 52 of the clamping member 30, which it can be seen are deflected or bent inwardly. Accordingly, each said corner provides a pair of edges 54 and 56, which, as will be discussed more fully hereinafter, will bite into the clamped wire to prevent pull-out.

Consideration is now directed to the operation of the assembly 16 upon clamping of the wire members 18 and 20. In this regard, the fastener 22 is backed out of the aperture 14 in block 12. Due to the captive mounting of the clamping member 30 thereon, it will be raised relative to the surface 10, thus facilitating initial positioning of the wires 18 and 20. Once these wires are positioned, the fastener is driven inwardly. With reference to FIG. 2, it can be seen that the fastener 22 advances the sloping surfaces 42 of the ramps 34 and 36 engage the wires 18 and 20. Most importantly, it will be noted that the sloping surface 42 tends to urge the wires 18 and 20 inwardly toward the central aperture 32 and the screw member 22, as the washer 30 is advanced with respect to the terminal member 10. Advantageously, the provision of the flatted surface 44 and rounded sloping surface 42 provides for firm engagement of the wires 18 and 20 while substantially preventing excessive cutting or damage thereto. Of additional importance is the fact that this inward movement of the wires 18 and 20, as urged by the ramp 34, will bring the wires into engagement with the side surfaces 45 of the opposing pair of ramps 38 and 40. thereby defining in limit of inward movement, and preventing excessive engagement with the fastener 22, the threaded portion 26 of which can damage the wire.

As seen in FIG. 2, the surface 42 of the ramp 34 tends to engage or deform somewhat the surface of the wires 18 and 20 when fully advanced, thus holding the wire 20 in firm engagement between the clamping member or washer 30, and the terminal member 10. Advantageously, the described ramp configuration is suitable for similarly engaging and urging inwardly both solid and stranded wires, over a considerable range of sizes or gauges. The rounded, continuous slope of the ramp surface 42 and trapezoidal taper thereof are significant features of the invention in this regard.

Directing attention to FIGS. 5 through 7, the function of the corners 46, 48, 50 and 52 of the generally square washer or clamping member 30 during clamping will now be considered. These corners are spaced slightly above the surface 44 of the ramps, such that said ramp 34 will engage the wire initially, and effect the above-described inward movement, before the edges 54 or 56 of the corners engage said wires. As the wire 18 or 20 is clamped, the edges 54 and 56 of the corners 48 and 52 will bite into the surface of said wire 18.

Thus, three points of gripping engagement are defined by the edge portions and ramps of the clamping member or washer 30 along the length of each of the wires 18 and 20. It will be appreciated, then, that the cooperation of the ramps 34 through 40 and downwardly turned corners 46 through 52 tend to align the wires 18 and 20 substantially parallel with each other at opposite sides of the screw member 22. Advantageously, the symmetrical arrangement of the ramps and corners facilitate the desired alignment and consequent gripping engagement of the wires 18 and 20. Moreover, this symmetrical arrangement permits similar engagement and clamping of wires by the washer 30 when oriented at a 90° rotated position from that illustrated, e.g, with the ramps 38 and 40 engaging the wires. Further, the three ares of biting engagement effectively preclude movement of the wires 18 and 20 in any direction, and advantageously provide an unexpected amount of resistance against any forces tending to pull the wires 18 and 20 out of the wire clamp assembly, once engaged therein.

Referring again to FIGS. 1 and 2 it will be noted that the ramps 34 through 40 and the downturned edges 46 through 52 may be simply and inexpensively formed in the clamping member or washer 30 by a single conventional stamping or coining operation. Moreover, it will be noted that such formation of the ramps and edges results in a complimentary form being imparted to the surface 58 of the washer facing the head or driver portion 24 of the screw member 22. In particular, with reference to the ramps 34 through 40, the surface 58 is formed with complimentarily configured hollows or valley portions 34*a*, 36*a*, 38*a* and 40*a*. As best seen in the partially cut-away view of FIG. 2, the valley or hollow portions 34*a* and 36*a* extend inwardly to substantially the same degree as the corresponding ramps, with respect to the outer periphery of the head or driver portion 24 of the screw member 22. Consequently, the engagement or bearing surface defined between the head portion 24 of the screw member 22 and the surface 58 of the washer 30 is substantially radially inwardly of the ramps 34 through 40 as indicated generally by the arrow 60. As best seen in FIG. 2, then the screw head 24 tends to bear upon the washer 30 at the arrow 60, generally radially inwardly, with respect to the screw member 22, of the point of engagement of the clamping member 16 with the wires 18 and 20. Thus, the larger wire 20 tends to cause the washer or clamping member 30 to assume a somewhat tilted position with respect to the axis of the screw member 22, for engaging the smaller wire 18. The diameter of the central aperture 32 of the washer 30 as mentioned above, is sufficiently large with respect to the shank 28 of the screw 22 to permit the relative movement required to attain this tilting action. Since the bearing of the screw head 24 upon the washer 30 is generally radially inwardly of the engagement of the washer 30 with the wire 20 it will be appreciated that tilting in the opposite direction, the wire 20 acting as fulcrum is not possible, thereby encouraging similar engagement of the ramp 36 and corners 48, 52 at the opposite side of the washer or clamping member 30 with a smaller wire such as the wire 18. In the case where two wires of equal diameter are to be engaged, such tilting is, of course, not present, the opposing ramps simultaneously engaging and clamping both wires.

What has been shown and described herein is a wire clamp assembly adapted for positioning and clamping either a single wire or a pair of wires substantially in parallel alignment, to form good mechanical and electrical connection therebetween and with a terminal member. The illustrated and described clamping member or washer further provides three points of biting engagement with the wire or wires being clamped thereby, thus substantially preventing movement of the wire in any direction once clamped. It will be particularly noted, that such biting engagement at three points renders the assembly especially resistant to pulling out of the wires once clamped therein. The described wire clamp assembly is further adapted for engaging a pair of wires of either solid or stranded configuration, and of different gauges, or relative sizes, over a considerable range of wire gauges.

While a preferred embodiment has been illustrated and described herein, the invention is not limited thereto. On the contrary, variations and modifications may occur to those skilled in the art, and are to be understood as forming a part of this invention insofar as such modifications fall within the spirit and scope of the appended claims.

The invention is claimed as follows:

1. In a screw and washer wire clamp assembly for a terminal member, a clamping member comprising: a substantially polygonal plate-like washer having a central aperture for receiving said screw to be urged thereby toward said terminal member, the surface of said washer member facing the terminal member including at least one ramp of increasing height in the direction of the periphery of said washer member, the side surface of said ramp tapering to diverge outwardly toward the outer periphery of said washer member for urging a wire to be clamped simultaneously inwardly with respect to said screw and in the direction of said terminal member, and for bitingly engaging said wire in response to full advancement of said washer toward said terminal member by said screw.

2. A clamping member according to claim 1 wherein said member includes a pair of corners on opposite sides of said ramp, said corners being turned downwardly in the direction of said terminal member thereby providing a pair of spaced edges for biting engagement with a wire conductor, with said ramp and edges serving to limit lateral movement of the wire relative to the screw, and said edges biting into said wire to prevent longitudinal movement with respect to said screw.

3. A clamping member according to claim 1 comprising a substantially rectangular washer, and further including four similar outwardly diverging and downwardly sloping ramps, each disposed substantially symmetrically with respect to the sides of said rectangular washer, one opposed pair of said ramps for engaging a pair of wires to be clamped on opposite sides of said screw, and the other opposed pair of ramps for defining a limit of inward movement of said wires, for maintaining said wires substantially parallel one to the other, and substantially parallel with the pair of sides of said washer member at which the first mentioned pair of opposed ramps are located.

4. A washer member according to claim 3 wherein said surface facing said terminal member further includes four corners sloping downwardly in the direction of said terminal member and each said corner defining peripheral pairs of edges for biting engagement with said wires when said screw is fully advanced with respect to said terminal member, thereby defining with said ramps three points of biting engagement between said washer and each of said wires, substantially resisting movement of said wires.

5. A washer member according to claim 3 wherein each of said ramps includes a substantially flat, nonsloping portion at the periphery of said washer, the wire engaging surface thereof being generally rounded, said flat and rounded portions substantially preventing cutting of the wire engaged thereby.

6. A wire clamp assembly for use with an internally threaded terminal member, comprising in combination: a screw member having an externally threaded portion for engagement with said internal thread of said terminal member, a driver head, and an unthreaded shank portion intermediate said head and said threaded portion, and a plate-like washer member mounted upon said unthreaded shank portion, and engageable by said head to be moved toward said terminal member for clamping at least one wire thereagainst, said washer member having an undersurface facing said flat terminal member surface, said undersurface including at least one ramp sloping radially outwardly of said screw and downwardly toward said terminal member, said ramp including side surfaces diverging radially outwardly with its narrower end laterally spaced from said screw member and its wider end generally parallel with an outer periphery of said washer member.

7. An assembly according to claim 6, wherein said member includes a pair of corners on opposite sides of said ramp, said corners being turned downwardly in the direction of said terminal member thereby providing a pair of spaced edges for biting engagement with a wire conductor, with said ramp and edges serving to limit lateral movement of the wire relative to the screw, and said edges biting into said wire to prevent longitudinal movement with respect to said screw.

8. An assembly according to claim 6 wherein said washer member is held in a captive relation relative to said screw member shank portion.

9. A wire clamp assembly according to claim 6 wherein said washer member is substantially rectangular and includes a central aperture of generally larger diameter than said unthreaded shank portion of said screw member, said undersurface including four similar outwardly diverging and downwardly sloping ramps, each disposed substantially symmetrically with respect to the sides of said square washer, one opposed pair of said ramps for engaging a pair of wires to be clamped at opposite sides of said screw, and the other opposed pair of ramps providing side surfaces for defining a limit of inward movement of said wires, thereby maintaining said wires substantially parallel one to the other and substantially parallel with the sides of said washer member at which the first mentioned pair of opposed ramps are located.

10. A wire clamp assembly according to claim 9 wherein said washer member undersurface further includes four downturned corners extending downwardly therefrom in the direction of said terminal member and each said corner defining peripheral pairs of edges for biting engagement with said wires, when said screw is fully advanced with respect to said terminal member, thereby defining with said ramps three points of biting engagement between said washer member and each of said wires and substantially preventing movement or withdrawal of said wires.

11. A wire clamp assembly according to claim 10 wherein said washer member further includes a bearing surface facing said driver head of said screw member, said bearing surface being generally complimentarily configured with said undersurface, and including four valley portions generally co-extensive with said ramps, and sloping away from said driver head, whereby said driver head bears substantially inwardly of said ramps.

12. A fastener and washer assembly adapted to provide a terminal connection for a terminal block or the like, said assembly including a fastener member having a head portion and a shank including a threaded segment thereon, and a washer member carried by said shank, said washer including a central aperture and being of a substantially rectangular configuration thereby defining alternating corner and peripheral portions and said washer having an undersurface facing away from said fastener head portion, said undersurface including at least one ramp disposed intermediate two of said corners and at the proximate midpoint of a peripheral portion, said ramp sloping radially outward from said aperture and increasing in height toward said peripheral portion, said ramp being defined by a pair of spaced edges which diverge in a direction toward said peripheral portion of the washer and away from said central aperture.

13. An assembly according to claim 12 wherein each said corner is turned downwardly, each defining a pair of peripheral edges disposed transversely of said wire for biting engagement therewith to prevent longitudinal movement of said wire.

14. A fastener and washer assembly according to claim 12 wherein four such ramps are provided each being disposed intermediate a pair of edges and each including diverging edges with the width of said ramp at said peripheral edge being greater than the diameter of said aperture, such that upon clamping of a wire with said assembly one of said ramps will force the wire inwardly toward said fastener, with said wire abutting edges portions of the adjacent ramps to provide at least a three-point contact.

15. An assembly according to claim 14, wherein each said corner is turned downwardly, each defining a pair of peripheral edges disposed transversely of said wire for biting engagement therewith to prevent longitudinal movement of said wire.

* * * * *